US006054028A

United States Patent [19]

Zingheim et al.

[11] Patent Number: 6,054,028

[45] Date of Patent: Apr. 25, 2000

[54] IGNITION CABLES

[75] Inventors: Steven Zingheim, Palo Alto; Michael Trowbridge, Union City; Mark Wartenberg, San Jose; Alan Yeung, Redwood City, all of Calif.

[73] Assignee: Raychem Corporation, Menlo Park, Calif.

[21] Appl. No.: 08/660,255

[22] Filed: Jun. 7, 1996

[51] Int. Cl.[7] ..... C25B 11/00

[52] U.S. Cl. ..... 204/290 R; 338/20; 338/21; 338/22 SD; 219/260; 219/264; 219/553

[58] Field of Search ..... 204/290 R; 338/21, 338/20, 22 SD; 219/260, 264, 553

[56] References Cited

U.S. PATENT DOCUMENTS

| | | | |
|---|---|---|---|
| 2,790,053 | 4/1957 | Peterson | 201/63 |
| 3,680,027 | 7/1972 | Vitale | 338/214 |
| 3,787,800 | 1/1974 | Barker et al. | 339/223 S |
| 3,818,412 | 6/1974 | Deardurff | 338/214 |
| 3,870,987 | 3/1975 | Wiley et al. | 338/214 |
| 3,991,397 | 11/1976 | King | 338/214 |
| 4,188,276 | 2/1980 | Lyons et al. | 204/159.17 |
| 4,193,651 | 3/1980 | Hays | 339/28 |
| 4,279,783 | 7/1981 | Kehrer et al. | 252/511 |
| 4,303,735 | 12/1981 | Kehrer et al. | 428/391 |
| 4,304,987 | 12/1981 | van Konynenburg | 219/553 |
| 4,330,493 | 5/1982 | Miyamoto et al. | 264/22 |
| 4,363,019 | 12/1982 | Miyamoto et al. | 338/214 |
| 4,366,464 | 12/1982 | Miyamoto et al. | 338/214 |
| 4,369,423 | 1/1983 | Holtzberg | 338/66 |
| 4,375,632 | 3/1983 | Miyamoto et al. | 338/214 |
| 4,677,418 | 6/1987 | Shulver | 338/214 |
| 4,689,601 | 8/1987 | Coffey et al. | 338/214 |
| 4,704,596 | 11/1987 | Coffey et al. | 338/214 |
| 4,721,474 | 1/1988 | Kanno et al. | 439/125 |
| 4,748,435 | 5/1988 | Yukawa et al. | 338/214 |
| 4,748,436 | 5/1988 | Kanamori et al. | 338/214 |
| 4,780,700 | 10/1988 | Wakabayashi et al. | 338/66 |
| 4,800,253 | 1/1989 | Kleiner et al. | 219/553 |
| 4,894,490 | 1/1990 | Fujimoto | 174/108 |
| 4,935,156 | 6/1990 | van Konyngnburg et al. | 219/553 |
| 4,970,488 | 11/1990 | Horiike et al. | 338/214 |
| 5,034,719 | 7/1991 | Brown et al. | 338/66 |
| 5,045,673 | 9/1991 | Kelly | 219/553 |
| 5,057,812 | 10/1991 | Yukawa et al. | 338/66 |
| 5,145,433 | 9/1992 | Yagi et al. | 445/7 |

FOREIGN PATENT DOCUMENTS

| | | |
|---|---|---|
| 0 433 870 | 6/1991 | European Pat. Off. . |
| 0 644 556 | 3/1995 | European Pat. Off. . |
| 0 696 808 A2 | 2/1996 | European Pat. Off. . |
| 0 700 056 A1 | 3/1996 | European Pat. Off. . |
| 9311230 | 11/1993 | Rep. of Korea . |
| 1277129 | 6/1972 | United Kingdom . |

OTHER PUBLICATIONS

Automotive Industries 156, 34–36, Jan. 1977, Walter H. Filbert.

Catalog No. 98654, Jan. 1996, Power Path Wire Products, pp. 1, 2, 64–66.

*Primary Examiner*—Bruce F. Bell

*Attorney, Agent, or Firm*—Timothy H. P. Richardson; Herbert G. Burkard

[57] ABSTRACT

Ignition cables which contain a layer of a melt-extruded conductive polymer. The conductive polymer is preferably the sole current-carrying component of the cable. The polymeric component in the conductive polymer is a fluoropolymer, preferably a vinylidene fluoride copolymer having a crystallinity index of 10 to 23% and/or a DSC heat of melting of 4.7 to 9.5 J/g. Preferably, the sole conductive filler in the conductive polymer is a carbon black.

14 Claims, 1 Drawing Sheet

IGNITION CABLES

BACKGROUND OF THE INVENTION

1. Field of the Invention

This invention relates to elongate conductors containing conductive polymers, especially ignition cables for automobiles.

2. Introduction to the Invention

The term "conductive polymer" is used in this specification to denote a composition which comprises a polymeric component and, dispersed or otherwise distributed in the polymeric component, a particulate conductive filler. Conductive polymers are well known. When the polymeric component is crystalline, many conductive polymers exhibit positive temperature coefficient (PTC) behavior in a temperature range which starts somewhat below the crystalline melting point. In general, the less crystalline the polymeric component, the less likely it is that the conductive polymer will exhibit sharp PTC behavior. When carbon black is the conductive filler, the nature of the carbon black is also an important factor in determining how resistivity varies with temperature (resistivities referred to in this specification are volume resistivities). Conductive polymers can be shaped in any appropriate way, but are preferably melt extruded, and can be crosslinked, e.g. by radiation, after they have been shaped. Conductive polymers have been widely used, for example, in antistatic flooring, as shielding in high voltage cables, and in devices in which current passes through the conductive polymer between metal electrodes, particularly self-regulating heaters and circuit protection devices which use PTC conductive polymers. For further information about conductive polymers, reference may be made for example to U.S. Pat. Nos. 4,237,441, 4,304,987, 4,388,607, 4,545,926, 4,560,498, 4,591,700, 4,724,417, 4,774,024, 4,935,156, 5,049,850, 5,250,228, and 5,378,407, the disclosures of which are incorporated herein by reference.

Ignition cables in automobiles must meet very stringent requirements. Thus, they must have satisfactory resistance and capacitance characteristics over a wide temperature range, and must retain those characteristics over a period of years in a very hostile physical environment. Many attempts have been made to provide such cables—see for example U.S. Pat. Nos. 2,790,053, 3,991,397, 4,330,493, 4,363,019, 4,375,632, 4,677,418, 4,704,596, 4,748,436, 4,780,700, 4,894,490, 4,970,488, 5,034,719, and 5,057,812, the disclosures of which are incorporated herein by reference. However the cable constructions which have proved commercially acceptable are complicated and expensive to make, and often require, in order to provide the desired combination of resistance, capacitance and size, two or more conductive components which must be applied in separate operations.

SUMMARY OF THE INVENTION

We have discovered, in accordance with the present invention, that through the use of conductive polymers comprising carbon black dispersed in a fluoropolymer, it is possible to provide substantially improved ignition cables. In particular, the sole current-carrying component of the cable can be a single extruded layer of a conductive polymer comprising carbon black dispersed in a fluoropolymer, or a combination of two co-extruded or tandem-extruded conductive polymer layers, at least one of the layers being composed of a conductive polymer comprising carbon black dispersed in a fluoropolymer. Such cables are cheaper and easier to make than known ignition cables. Alternatively, other current-carrying components can also be present, in which case use of an extruded layer of a conductive polymer comprising carbon black dispersed in a fluoropolymer makes it possible to reduce the current which needs to be carried by such other components and/or to improve the cable in some other respect.

An important factor in the selection of the fluoropolymer-based conductive polymer is the crystallinity of the fluoropolymer. If the crystallinity is too high, then it is impossible, when a single extruded layer is used, to obtain an extruded product whose resistance is low at room temperature and which does not increase too much as the temperature is increased, as is desired in an ignition cable. On the other hand, if the crystallinity is too low and the conductive polymer is the outer layer of the extruded product, this will result in "blocking" unless special measures are taken to prevent it. The term "blocking" is used to describe unwanted adhesion between adjacent wraps of the extruded product when it is wound up on a reel. This invention preferably makes use of a fluoropolymer-based conductive polymer whose crystallinity is such that neither resistance variation with temperature nor blocking is a problem, so that a single layer of the conductive polymer can be used. However, the invention also includes cables in which the fluoropolymer-based conductive polymer has a lower crystallinity, and is covered, before the extruded product is wound up on a reel, by a second layer of a non-blocking conductive polymer. The second layer can be relatively thin so that, even if the resistivity of the non-blocking conductive polymer increases quite sharply with temperature, this does not result in an unacceptable increase in the resistance of the two layers taken together. The second layer can be co-extruded or tandem-extruded over the fluoropolymer-based layer. It is also possible to cover the fluoropolymer-based layer with a coextruded or tandem-extruded non-blocking layer of an insulating polymer, before the cable is wound up on a reel; however, when the insulating polymer is coextruded, the resulting products are not satisfactory in use, because it is very difficult to strip the insulating non-blocking layer in order to connect the cable.

In a first preferred aspect, this invention provides a cable which is an ignition cable or which can be converted into an ignition cable, and which comprises (1) a core comprising a plurality of non-metallic electrically insulating fibers;

(2) an electrically conductive layer which
  (a) surrounds and contacts the core, and
  (b) is composed of a conductive polymer which has been melt extruded around the core and which comprises
    (i) a polymeric component comprising a fluoropolymer, and
    (ii) dispersed in the polymeric component, a particulate electrically conductive filler which consists essentially of one or more carbon blacks; and (3) an electrically insulating polymeric layer which surrounds the electrically conductive layer.

In a second preferred aspect, this invention provides a cable which is an ignition cable, or which can be converted into an ignition cable, and which comprises (1) a core comprising a plurality of non-metallic electrically insulating fibers;

(2) a first electrically conductive layer which
  (a) surrounds and contacts the core,
  (b) is composed of a first conductive polymer which has been melt extruded around the core and which comprises (i) a first polymeric component comprising a fluoropolymer, and
(ii) dispersed in the polymeric component, a particulate electrically conductive filler, and
(c) has a first wall thickness; and
(3) a second electrically conductive layer which
(a) surrounds and contacts the first electrically conductive layer,
(b) is composed of a second conductive polymer which has been extruded around the first electrically conductive layer by a process selected from coextrusion and tandem extrusion, and comprises
(i) a second polymeric component, and
(ii) a particulate electrically conductive filler, and
(c) has a second wall thickness which is at most 0.3 times the wall thickness of the first electrically conductive layer; and
(4) an electrically insulating polymeric layer which surrounds and contacts the second electrically conductive layer.

In a third preferred aspect, this invention provides a cable which is an ignition cable, or which can be converted into a ignition cable, and which comprises
(1) a core which
(a) comprises a plurality of non-metallic electrically insulating fibers, and
(b) has a diameter of 0.010 to 0.035 inch; and
(2) an electrically conductive layer which
(a) has a wall thickness of 0.006 to 0.050 inch,
(b) surrounds and contacts the core,
(c) has a resistance at 25° C. of 400 to 20,000 ohms/foot, and
(d) is composed of a conductive polymer which
(i) has been melt extruded around the core,
(ii) has a resistivity at 25° C., $\rho_{25}$, of 0.3 to 15 ohm-cm and a resistivity at 260° C., $\rho_{260}$, which is at most 3 times its resistivity at 25° C., and
(iii) comprises a polymeric component comprising a fluoropolymer and, dispersed in the polymeric component, a particulate electrically conductive filler which consists essentially of one or more carbon blacks.

In a fourth preferred aspect, this invention provides a cable which is an ignition cable or which can be converted into an ignition cable, and which comprises
(1) a core which
(a) comprises a plurality of non-metallic electrically insulating fibers, and
(b) has a diameter of 0.010 to 0.035 inch;
(2) a first electrically conductive layer which
(a) has a wall thickness of 0.008 to 0.050 inch,
(b) surrounds and contacts the core,
(c) has a resistance of 400 to 20,000 ohms/foot, and
(d) is composed of a conductive polymer which
(i) has been melt extruded around the core,
(ii) has a resistivity at 25° C., $\rho_{25}$, of 0.3 to 15 ohm-cm and a resistivity at 260° C., $\rho_{260}$, which is at most 3 times its resistivity at 25° C., and
(iii) comprises a polymeric component comprising a fluoropolymer and, dispersed in the polymeric component, a particulate electrically conductive filler; and
(3) a second electrically conductive layer which
(a) surrounds and contact the first electrically conductive layer,
(b) is composed of a second conductive polymer which has been extruded around the first electrically conductive layer by a process selected from coextrusion and tandem extrusion, and comprises
(i) a second polymeric component, and
(ii) a particulate electrically conductive filler, and
(c) has a second wall thickness which is at most 0.3 times the wall thickness of the first electrically conductive layer.

In a fifth preferred aspect, this invention provides a method of making a cable which comprises
(A) melt-extruding, around a core comprising a plurality of non-metallic electrically insulating fibers, a conductive polymer which comprises
(i) a polymeric component comprising a fluoropolymer which contains at least 61% by weight of fluorine and has an initial crystallinity index of 14 to 24%, and
(ii) dispersed in the polymeric component, a particulate electrically conductive filler which consists essentially of one or more carbon blacks.

BRIEF DESCRIPTION OF THE DRAWING

The invention is illustrated in the accompanying drawing, in which.

DETAILED DESCRIPTION OF THE INVENTION

Figure 1:
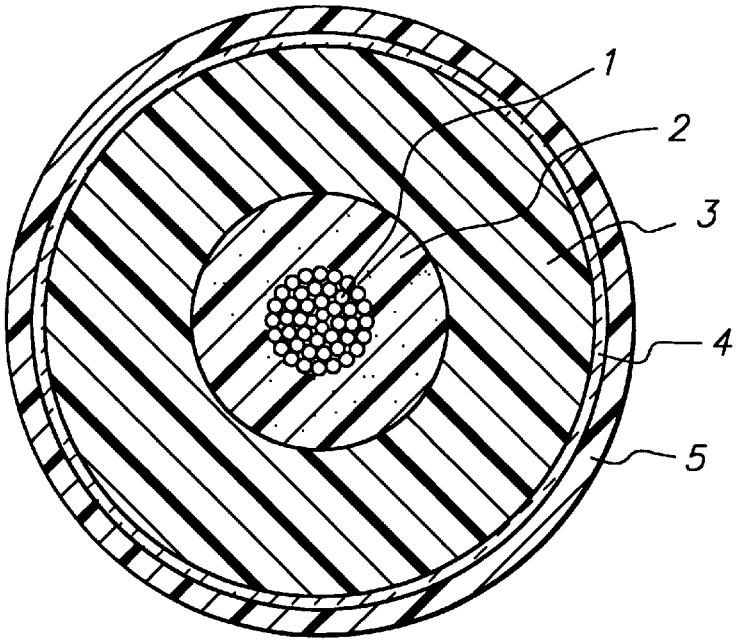
FIGS. 1 and 2 are cross-sectional views through an ignition cable of the present invention.

In this specification, parts and percentages are by weight, and the term "fiber" is used herein to include continuous filaments and discontinuous fibers of all lengths. The term "crystallinity index" is used herein to define the crystallinities of the polymeric starting materials and the final products. Due to the effects of processing, it is not possible to predict with any certainty (although it is possible to determine, through trial and error) the crystallinity of a final product which will be obtained from starting materials of known crystallinity. Similarly, it is not possible to determine from final products (except through trial and error using likely starting materials) the crystallinities of the starting materials used to make those final products. In the interests of clarity, the crystallinity indexes given herein are referred to as initial crystallinity indexes when they are measured on a polymer or a mixture of polymers before the conductive filler is added to it and before any other processing is carried out, and as final crystallinity indexes when they are measured on final products. The Crystallinity Indexes given in this specification are calculated from data obtained by standard powder X-ray diffraction techniques, and are a measure of the intensity of the scattering produced by the crystalline part of the polymeric component of the sample, expressed as a percentage of the scattering produced by the total polymeric component (i.e. both crystalline and amorphous) of the sample, excluding scattering due to any non-polymeric components. For general background information about this technique, reference may be made to "General Procedure for Evaluating Amorphous Scattering and Crystallinity from X-Ray Diffraction Scans of Semi-Crystalline Polymers" by Murthy, N. S., and Minor, H., in Polymer 31, 996–1002 (1990). The precise procedure used to determine Crystallinity Index is as follows.

1. Collect an X-ray diffraction pattern from the sample, using copper K-alpha radiation (wavelength 1.54 Å) over a scattering angle two-theta=10°–30°.
2. Import pattern data into the software package created by S. A. Howard and available under the name SHADOW v.3.40 from Materials Data Inc., Livermore, Calif., USA.

3. Establish a preliminary baseline using a linear interpolation between the background at two-theta=10° and the background in the vicinity of two-theta=30°.
4. Manually determine the position of the polymeric amorphous halo, which can be identified as the broad scattering feature with a full-width-half-maximum of greater than two-theta=3.0° (FWHM=3.0°). Select a peak in SHADOW with this position and a FWHM=4.0° as a starting value.
5. Assign peaks in the pattern to account for any known non-polymeric crystalline or amorphous phases in the sample.
6. Assign a peak or peaks for any remaining scattering features that can be visually identified in the diffraction pattern. These features represent the crystalline component of polymeric x-ray scattering. Select these peaks in SHADOW with FWHM=2.0° as a starting value.
7. Select a first order polynomial function for the background.
8. Select the pseudo-Voigt profile-shape-function (PSF) for the pattern. [The pseudo-Voigt PSF is a mathematical function which is routinely used for profile fitting of powder diffraction patterns—see "Profile fitting of Powder Diffraction Patterns" by Howard, S. A., and Preston, K. D., in Reviews in Mineralogy, volume 20 (1989).]
9. Constrain the mixing parameters for all polymer diffraction features to be tied together during refinement and assign a starting value of 0.5.
10. Refine the profile model, which will include the background and the peak position, FWHM, peak height and mixing parameter for each scattering feature.
11. If FWHM for the crystalline polymeric peak or peaks exceeds FWHM=2.0°, fix those FWHM=2.0° and repeat the refinement. If the new results do not appreciably degrade the weighted residual or goodness of fit criteria for the refinement then continue refinement of the profile model until convergence.
12. After the refinement converges, use the area values for the polymeric amorphous halo and the polymeric crystalline peaks to calculate the crystallinity index.

Another way of assessing crystallinity is by measuring the DSC heat of melting. DSC heats of melting referred to herein are measured using standard differential scanning calorimeter (DSC) techniques as further defined below. The DSC is calibrated with standards having known melt temperatures and heats of melting, and the samples are tested under a nitrogen atmosphere. A sample of about 10–11 mg is heated to 200° C.; held at 200° C. for 3 minutes; cooled at 10° C./minute to 0° C.; held at 0° C. for 5 minutes; and reheated to 200° C. at 10° C./minute. The DSC trace obtained in the second heating is integrated between 70° C. and 148° C. to obtain the DSC heat of melting in J/g.

Conductive Polymers

The conductive polymers which are preferably used in this invention fall into three categories which can overlap to some extent, namely:

I. compositions suitable for use when there is a single layer of a conductive polymer, II. compositions suitable for use as the first (inner) layer when there is also a second layer, and III. compositions suitable for use as the second (outer) layer.

All of these compositions can contain conventional additives.

I. Conductive Polymers for use as a Single Layer

The conductive polymers for use as a single layer preferably have a resistivity at 25° C., $\rho_{25}$, of 0.1 to 15 ohm-cm, particularly 0.3 to 15 ohm-cm, especially 0.3 to 5 ohm-cm, more especially 0.4 to 5 ohm-cm. It is also preferred that the resistivity at 260° C., $\rho_{260}$, is at most 3 times, preferably at most 2 times, $\rho_{25}$.

Preferred features of the polymeric component of the conductive polymer compositions in this category include one or more of the following.

1. It contains at least 61%, particularly at least 62%, especially at least 64%, fluorine.
2. It has an initial crystallinity index of 14 to 24%, and/or has a crystallinity such that the final product has a final crystallinity index of 10 to 23%, preferably 12 to 20%, and/or a DSC heat of melting of 4.7 to 9.5, preferably 5.7 to 8.6, particularly 6.5 to 8.6 J/g. In this way, the conductive polymer has a crystallinity which (a) is high enough to ensure that the extruded product is not subject to blocking when it is wound up on a reel, but (b) is low enough to ensure that the resistivity of the conductive polymer does not rise unacceptably when the temperature increases from room temperature to the maximum temperature at which the ignition cable is to be used.
3. All the repeating units therein are derived from vinylidene fluoride and one or more comonomers, e.g. a fluorinated olefin.
4. It contains at least 60%, preferably 65 to 85%, by weight of units derived from vinylidene fluoride, and at least 10%, preferably 15 to 35%, by weight of units which are randomly copolymerized with the vinylidene fluoride units and which are derived from one or more comonomers, e.g. fluorinated olefin, for example tetrafluoroethylene or hexafluoropropylene.

Such a polymeric component can be conveniently prepared by blending together (a) a vinylidene fluoride homopolymer or copolymer which has a relatively high initial crystallinity index, e.g., for a copolymer, 30 to 40%, preferably 32 to 38%, and (b) a vinylidene fluoride copolymer which has a relatively low initial crystallinity index or is substantially amorphous, e.g. has an initial crystallinity index of 0 to 10%, preferably 0 to 5%. The term "copolymer" is used herein to denote a polymer derived from two or more monomers, i.e. it includes terpolymers. Polymers of type (a) which are commercially available include (i) the product sold at the date of filing of this application under the trade name KYNARFLEX 2800 (KYNARFLEX being a Registered Trademark), which has an initial crystallinity index of about 35% and is believed to be a copolymer of vinylidene fluoride and hexafluoropropylene in a weight ratio of about 90:10 and which is available from Atochem, (ii) the product sold at the date of filing of this application under the trade name HYLAR 460 (HYLAR being a Registered Trademark), available from Ausimont, (iii) the products sold at the date of filing of this application under the trade names SOLEF 1010, SOLEF 31508 and SOLEF 32008 (SOLEF being Registered Trademark), available from Solvay, and the product sold at the date of filing of this application under the trade name KF 1000 (KF 1000 being a Registered Trademark), available from Kureha. Polymers of type (b) which are commercially available include amorphous fluoroelastomers such as (i) the products sold at the date of filing of this application under the tradename VITON A (VITON being a Registered Trademark), which is believed to be a copolymer of vinylidene fluoride and hexafluoropropylene and is available from duPont, (ii) the product sold at the date of filing of this application under the trade name VITON B (VITON being a Registered Trademark), which is believed to be a terpolymer of vinylidene fluoride, hexafluoropropylene and tetrafluoroethylene and is available from duPont, and (iii) the product sold at the date of filing of this application under the trade name FLUOREL FC 2145 (FLUOREL being a Registered Trademark), which is believed to be a copolymer of vinylidene fluoride and hexafluoropropylene and is available from 3M Corporation.

Polymers of type (a) are generally less expensive than polymers of type (b) and it is generally preferred, therefore, to use as high a proportion of the type (a) polymer as is consistent with the desired properties, in particular a resistivity which remains sufficiently low at elevated temperatures. The weight ratio of the polymer of type (a) to the polymer of type (b) is generally 2:1 to 1:2, preferably 1:1 to 1.5:1.

II. Conductive Polymers for use as the Inner Layer of Two Layers

The conductive polymers for use as the inner layer of two layers need not have a crystallinity such that, if used alone, the extruded product is not subject to blocking. Thus the polymeric component preferably has an initial crystallinity less than 20%, for example less than 14%. The resistivity of the conductive polymers in this category II is preferably as described above for the conductive polymers of category I. The polymeric component of the conductive polymers in this category II preferably has one or more of the following features.

1. It contains at least 63% fluorine, particularly at least 65% fluorine.
2. All the repeating units therein are derived from vinylidene fluoride and one or more comonomers, e.g. a fluorinated olefin.
3. It contains at least 55% by weight of units derived from vinylidene fluoride and at least 15%, preferably 20 to 45% by weight of units which are randomly copolymerized with the vinylidene fluoride units and which are derived from one or more comonomers, e.g. a fluorinated olefin.

Examples of suitable polymers are blends of a polymer of type (a) and a polymer of type (b) as described in Category I above, the ratio of the polymers in the blend being such that the blend has the desired crystallinity.

III. Conductive Polymers for use as the Outer Layer of Two Layers

The outer layer of conductive polymer, when used, is preferably relatively thin, so that its resistivity is not a very important factor in the electrical properties of the overall cable. Thus its wall thickness is preferably at most 0.3 times, particularly at most 0.2 times, the wall thickness of the first conductive polymer layer, e.g. 0.001 to 0.005 inch. Consequently, although it is preferred that this conductive polymer have a low resistivity, it can be substantially higher than the resistivity of the inner layer, e.g. up to 10,000 ohm-cm at 25° C. The resistivity should be sufficiently low to permit electrical connections to the cable to be made through the outer layer. Similarly, although it is preferred that the resistivity should not increase unduly with temperature, quite a large increase can be tolerated. Thus, the resistivity of the composition at 260° C. is preferably not more than 100 times its resistivity at 25° C.

Preferred features of the polymeric component of the conductive polymers used in the second layer include one or more of the following.

1. It contains at least 55%, particularly at least 58%, by weight of fluorine.
2. It has an initial crystallinity index of at least 25%.
3. All the repeating units therein are derived from vinylidene fluoride and/or a fluorinated olefin, and/or an olefin.

Examples of suitable polymers include ethylene/tetrafluoroethylene copolymers, fluorinated ethylene/propylene copolymers, and blends of a polymer of type (a) and a polymer of type (b) as described in Category I above, the ratio of the polymers in the blend being such that the blend has the desired crystallinity.

Conductive Fillers

In the conductive polymers in each of categories I, II and III, the conductive filler preferably consists essentially of one or more carbon blacks. Carbon blacks are well known particulate materials and are distinct from fibrous carbon materials. Preferably the conductive filler consists of one or more carbon blacks each having a particle size (D) in millimicrons and a surface area (S) in $m^2/g$ such that S/D is at least 10, preferably at least 12, especially at least 18, as disclosed in U.S. Pat. No. 4,304,987, the disclosure of which is incorporated herein by reference. However, other carbon blacks can be used, especially in the conductive polymers in category III above, e.g. the carbon black sold at the date of filing of this application under the trade name VULCAN XC-72 (VULCAN being a Registered Trademark). We have obtained excellent results using a carbon black sold at the date of filing of this application under the tradename KETJENBLACK 300 J (KETJENBLACK being a Registered Trademark) by Akzo Chemicals Inc. The amount of carbon black (and/or other filler) should be high enough to provide the desired resistivity, but low enough to permit the conductive polymer to be melt extruded around the core. Using Ketjenblack 300J, a suitable amount is 16 to 18% by weight.

The Core

The core comprises electrically insulating fibers. The number of fibers can be large or small, and the fibers can be twisted, braided, or plaited together. Preferably all the fibers are the same. The fibers can be composed of organic or inorganic material. For example, they may be glass fibers or fibers composed of an organic polymers, preferably a high strength polymer, e.g. an aromatic polymer such as an aromatic polyamide, polyimide, or polyketone. The diameter of the core is generally 0.010 to 0.035 inch.

Many known ignition cables comprise a non-metallic core which contains electrically conductive components, e.g. particles which are deposited on or distributed through the core so that it is conductive. An advantage of the present invention is that such measures are not needed in most circumstances. However, the invention includes the possibility that the core contains other components in addition to non-metallic fibers, e.g. particles which are distributed uniformly or non-uniformly in the core (e.g. mainly or exclusively in a surface layer of the core) and which modify the electrical characteristics of the finished cable, for example, conductive or ferromagnetic particles. The core may also be impregnated by a non-conductive binder which improves the physical properties of the core.

Processing

The conductive polymer composition of category I or II is melt-extruded around the core so that there is intimate contact between the core and the conductive polymer. Pressure extrusion is preferred. The extruded layer is generally of annular cross-section with a wall thickness of 0.006 to 0.050 inch, preferably 0.008 to 0.035 inch, and an outer diameter of 0.022 to 0.110 inch, so that the longitudinal resistance of the layer is at least 400, preferably 1,000 to 10,000 ohm/foot.

The conductive polymer composition of category III, when used, is coextruded or tandem-extruded around the inner layer so that there is intimate contact between them.

If the cable may be exposed to temperatures which approach or exceed the softening point of the polymeric layer or one of the polymeric layers therein, then the polymeric layer should be crosslinked to ensure that it does not flow during use. The crosslinking is preferably effected by radiation, e.g. to a dose of 5 to 40, particularly 8 to 20, megarads.

Other Components of the Ignition Cable

The product of melt-extruding the conductive polymer composition(s) around the core is in itself a useful article of commerce which can be sold to manufacturers of ignition cables and further processed by them. Such further processing includes the addition of a high voltage insulating layer which surrounds the conductive polymer layer, e.g. a layer of a cured silicone, a polyolefin or chlorinated polyolefin. Often the high voltage insulating layer will be surrounded by a braid of a high strength fiber, and the braid will be covered by an outer jacket of a flame-retarded polymeric composition. Many known ignition cables comprise one or more high resistance metal wires which are spirally wrapped along the core to provide a component which not only is conductive, but also contributes inductance. One of the advantages of this invention is that such wires are not needed in most circumstances. However, the invention includes the possibility that one or more such wires are spirally wrapped around the layer of melt-extruded conductive polymer composition.

Figure 2:
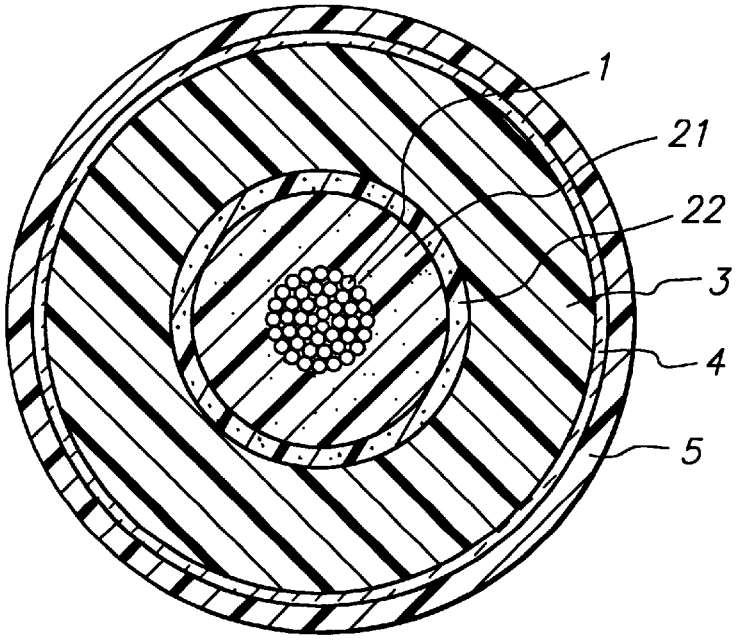

Referring now to the drawing, FIG. 1 shows a core 1 of insulating fibers, e.g. polyaramid fibers sold at the date of filing of this application under the trade name KEVLAR (KEVLAR being a Registered Trademark). by duPont, the core being surrounded and intimately contacted by a melt-extruded layer 2 of a conductive polymer in which the polymeric component is a blend of a vinylidene fluoride polymer having substantial crystallinity, e.g. KYNARFLEX 2800, and a vinylidene fluoride polymer having a relatively low (or no) crystallinity, e.g. the product sold at the date of filing of this application under the trade name VITON A 200, in a ratio of 1:1 to 1.5:1. Surrounding the melt-extruded layer 2 are a high voltage insulating layer 3, a braid of glass fibers 4, and an outer insulating layer 5 of a flame-retarded insulating polymeric composition. FIG. 2 is similar to FIG. 1, except that there are two coextruded layers of conductive polymer, the inner layer 21 being composed of a conductive polymer in which the polymeric component is a blend of a vinylidene fluoride polymer having substantial crystallinity and a fluoropolymer having a relatively low or no crystallinity, the blend containing less than 40% of the more crystalline fluoropolymer, and the outer layer 22 being composed of a conductive polymer in which the polymeric component is relatively crystalline.

EXAMPLES

The invention is illustrated by the following Examples, which are summarized in the Table below. Examples 1, 2 and 3 are examples of the invention in which a single layer of a conductive polymer was extruded around the core. Examples 4 and 6 are comparative examples showing use of a conductive polymer which is unsatisfactory as a single layer because it causes blocking. Example 5 is an example of the invention in which two layers of conductive polymer were coextruded as a loose jacket around the core. In each of the Examples, the core was a multifilament polyaramid (KEVLAR) yarn having a diameter of 0.024 inch, which had been passed through an oven at about 700° F. to volatilize surface residues thereon.

In each Example, the ingredients and amounts thereof shown in the Table were melt mixed, strand pelletized, and melt extruded (co-extruded in Example 5) around the core. The extrusion was at about 220–225° C. in Examples 1–4 and 6. In Example 5, the inner layer was extruded at about 220° C. and the outer layer at about 290° C. In each Example, the product was wound up on a reel and, after a period of at least 24 hours was unwound to assess the extent of any blocking. In Examples 1, 2 and 5, there was no blocking, in Example 3 there was some sticking between adjacent cables, but the conductive polymer layer was not damaged. In Examples 4 and 6, the conductive polymer layer was damaged. In Examples 1–4 and 6, the cable was then irradiated to a dosage of about 10 Mrad to crosslink the conductive polymer. The properties of the final products are shown in the Table.

The following abbreviations are used in the Table.

K2800 is KYNARFLEX 2800, as described above.

Tefzel 200 is an ethylene/tetrafluoroethylene copolymer which is the product sold at the date of filing of this application under the trade name TEFZEL 200 (TEFZEL being a Registered Trademark) which is available from du Pont, and which is believed to have an initial crystallinity index of 20 to 30% or more.

Fluorel FC 2145 is FLUOREL FC 2145, as described above.

Viton A 200 is VITON A 200, which is amorphous, which is belied to be a copolymer of tetrafluoroethylene and vinylidene fluoride, and which is available from du Pont.

Viton A 100 is the product sold at the date of filing of this application under the trade name VITON A 100, which is amorphous, which is believed to be a copolymer of tetrafluoroethylene and vinylidene fluoride, and which is available from du Pont.

Dai-el T 530 is the product sold at the date of filing of this application under the trade name DAI-EL T530 (DAI-EL being a Registered Trademark), which is available from Daikin and which is believed to be a thermoplastic elastomer containing vinylidene fluoride units as described in U.S. Pat. No. 4,158,678.

Ketjen 300J is a carbon black with a particle size of 30 millimicrons and a BET surface area of 800 $m^2/g$ available from Akzo Chemicals Inc. under the tradename KETJENBLACK 300J (as described above).

XC 72 is a carbon black with a particle size of 30 millimicrons and a BET surface area of 254 $m^2/g$ available from Cabot Corporation under the tradename VULCAN XC-72 (as described above).

The outer layer in Example 5 contained, in addition to the ingredients shown in the Table, 0.50 parts of an antioxidant (the product sold at the date of filing of this application under the trade name IRGANOX 1010 (IRGANOX being a Registered Trademark), available from Ciba Geigy), 0.1 parts of distearyl dithiodipropionate, and 6 parts of triallyl isocyanurate.

TABLE

| | Example No | | | | | | |
|---|---|---|---|---|---|---|---|
| | | | | | 5 | | |
| | 1 | 2 | 3 | 4* | Inner | Outer | 6* |
| Ingredients | | | | | | | |
| K 2800 | 45.4 | 45.4 | 41.5 | 24.6 | 20.8 | — | 16.4 |
| Tefzel 200 | — | — | — | — | — | 41.80 | — |
| Fluorel FC-2145 | 37.6 | — | — | — | — | — | — |
| Viton A 200 | — | 37.6 | 41.5 | — | — | — | 65.6 |
| Viton A 100 | — | — | — | 57.4 | 62.2 | — | — |
| Dai-el T-530 | — | — | — | — | — | 36.10 | — |
| Ketjen 300J | 17 | 17 | 17 | 18 | 17 | — | 18 |
| XC 72 | — | — | — | — | — | 15.5 | — |
| Dimensions | | | | | | | |
| Inner diameter (in.) | 0.024 | 0.024 | 0.024 | 0.024 | 0.184 | — | 0.024 |
| Outer diameter (in.) | 0.056 | 0.056 | 0.056 | 0.071 | — | 0.304 | 0.070 |
| Resistivities | | | | | | | |
| at 25° C. (ohm-cm) | 1.05 | — | 0.90 | 1.14 | 1.72 | 2.59 | 1.25 |
| at 260° C. (ohm-cm) | 0.97 | — | 1.08 | — | — | — | — |
| Resistances (ohm/ft.) | | | | | | | |
| Initial | 2,660 | 2,630 | 1,130 | — | — | — | — |
| After 900 hr. at 200° C. | 2,130 | 2,150 | — | — | — | — | — |
| Final Crystallinity Index (%) | 15 | — | — | — | — | — | 9 |
| DSC Heat of Melting (J/g) | 7.9 | — | — | — | — | — | 2.6 |

*Comparative Example

What is claimed is:

1. A cable which comprises (1) a core comprising a plurality of non-metallic electrically insulating fibers;

(2) an electrically conductive layer which
  (a) surrounds and contacts the core, and
  (b) is composed of a conductive polymer composition which has been melt extruded around the core and which comprises
    (i) a polymeric component which comprises a fluoropolymer which contains at least 62% by weight of fluorine, and which has a final crystallinity index of 10 to 24%, and
    (ii) dispersed in the polymeric component, a particulate electrically conductive filler which consists essentially of one or more carbon blacks; and (3) an electrically insulating polymeric layer which surrounds and contacts the electrically conductive layer.

2. A cable according to claim 1 wherein the polymeric component in the conductive polymer has a final crystallinity index of 12 to 20%.

3. A cable according to claim 1 wherein the polymeric component contains at least 60% by weight of units derived from vinylidene fluoride and at least 10% by weight of other units which are randomly copolymerized with the vinylidene fluoride units and are derived from one or more fluorinated olefin comonomers.

4. A cable according to claim 3 wherein the polymeric component in the conductive polymer has a heat of melting, measured by a differential scanning calorimeter, of 4.7 to 9.5 J/g.

5. A cable according to claim 4 wherein the polymeric component in the conductive polymer has a heat of melting, measured by a differential scanning calorimeter, of 6.5 to 8.6 J/g.

6. A cable according to claim 3 wherein the electrically conductive layer has a wall thickness of 0.006 to 0.050 inch, and the conductive polymer composition has been radiation crosslinked, has a resistivity at 25° C., $\rho_{25}$, of 0.3 to 15 ohm-cm, and has a resistivity at 260° C., $\rho_{260}$, which is at most 3 times its resistivity at 25° C.

7. A cable according to claim 3 which is suitable for use as an ignition cable and which also contains (4) an electrically insulating braid which surrounds and contacts the electrically insulating layer; and (5) an outer electrically insulating polymeric layer which surrounds and contacts the braid.

8. A cable which comprises (1) a core which
  (a) comprises a plurality of non-metallic electrically insulating fibers, and
  (b) has a diameter of 0.010 to 0.035 inch; and (2) an electrically conductive layer which
  (a) has a wall thickness of 0.006 to 0.050 inch,
  (b) surrounds and contacts the core,
  (c) has a resistance at 25° C. of 400 to 20,000 ohms/foot, and
  (d) is composed of a conductive polymer composition which (i) has been melt extruded around the core, (ii) has a resistivity at 25° C., $\rho_{25}$, of 0.3 to 15 ohm-cm and a resistivity at 260° C., $\rho_{260}$, which is at most 3 times its resistivity at 25° C., and (iii) comprises a polymeric component comprising a fluoropolymer and, dispersed in the polymeric component, a particulate electrically conductive filler which consists essentially of one or more carbon blacks.

9. A cable according to claim 8 wherein the polymeric component contains at least 62% by weight of fluorine and has a final crystallinity index of 12 to 20%.

10. A cable according to claim 8 wherein the polymeric component (a) contains at least 60% by weight of units derived from vinylidene fluoride and at least 10% by weight of other units which are randomly copolymerized with the vinylidene fluoride units and are derived from one or more fluorinated olefin comonomers;

(b) has a heat of melting, measured by a differential scanning calorimeter, of 4.7 to 9.5 J/g; and (c) has been radiation crosslinked.

11. A cable according to claim 8 which is suitable for use as an ignition cable and which also contains (3) an electrically insulating polymeric layer which surrounds the electrically conductive layer;

(4) an electrically insulating braid which surrounds and contacts the electrically insulating layer; and (5) an outer electrically insulating polymeric layer which surrounds and contacts the braid.

12. A cable which comprises (1) a core comprising a plurality of non-metallic electrically insulating fibers;

(2) a first electrically conductive layer which (a) surrounds and contacts the core, (b) is composed of a first conductive polymer which has been melt extruded around the core and which comprises (i) a first polymeric component comprising a fluoropolymer, and (ii) dispersed in the polymeric component, a particulate electrically conductive filler, and (c) has a first wall thickness; and (3) a second electrically conductive layer which (a) surrounds and contacts the first electrically conductive layer, (b) is composed of a second conductive polymer which has been extruded around the first electrically conductive layer by a process selected from coextrusion and tandem extrusion, and comprises (i) a second polymeric component, and (ii) a particulate electrically conductive filler, and (c) has a second wall thickness which is at most 0.3 times the wall thickness of the first electrically conductive layer; and (4) an electrically insulating polymeric layer which surrounds and contacts the second electrically conductive layer.

13. A cable according to claim 12 wherein the polymeric component in the first conductive polymer composition contains at least 62% of fluorine, has a final crystallinity index of less than 20%, and contains at least 90% by weight of (a) units derived from vinylidene fluoride and (b) other units which are randomly copolymerized with the vinylidene fluoride units and which are derived from one or more fluorinated olefin comonomers; and the polymeric component in the second conductive polymer composition contains at least 55% by weight of fluorine, has a final crystallinity index of at least 14%, and contains at least 90% by weight of (a) units derived from vinylidene fluoride and (b) other units which are randomly copolymerized with the vinylidene fluoride units and which are derived from one or more fluorinated olefin comonomers.

14. A cable according to claim 12 wherein (a) the first electrically conductive layer has a wall thickness of 0.006 to 0.050 inch, (b) the first conductive polymer composition has a resistivity at 25° C., $\rho_{25}$ of 0.3 to 15 ohm-cm, and a resistivity at 260° C., $\rho_{260}$, which is at most 3 times its resistivity at 25° C., and (c) the second electrically conductive layer has a wall thickness which is (i) at most 0.3 times the wall thickness of the first electrically conductive layer, and (ii) 0.001 to 0.005 inch.

* * * * *